US011154135B2

(12) United States Patent
Phipps

(10) Patent No.: US 11,154,135 B2
(45) Date of Patent: Oct. 26, 2021

(54) EQUIPMENT SUPPORT APPARATUS

(71) Applicant: RHINO VISIONS, LLC, Marietta, SC (US)

(72) Inventor: Harold S. Phipps, Marietta, SC (US)

(73) Assignee: RHINO VISIONS, LLC, Marietta, SC (US)

( * ) Notice: Subject to any disclaimer, the term of this patent is extended or adjusted under 35 U.S.C. 154(b) by 0 days.

(21) Appl. No.: 16/506,028

(22) Filed: Jul. 9, 2019

(65) Prior Publication Data

US 2021/0007482 A1 Jan. 14, 2021

(51) Int. Cl.
*A47B 91/12* (2006.01)

(52) U.S. Cl.
CPC ..... *A47B 91/12* (2013.01)

(58) Field of Classification Search
CPC ..... A47B 91/005; A47B 91/12; A47B 91/16
USPC ..... D8/374; 248/188.2, 188.4, 188.9, 206.5, 248/609.4; D25/112–118
See application file for complete search history.

(56) References Cited

U.S. PATENT DOCUMENTS 2,868,602 A * 1/1959 Drezner ..... F16B 12/48 403/298
2,893,164 A * 7/1959 Martin ..... A47B 91/12 248/188.2
2,902,794 A * 9/1959 Ehrgott ..... A47B 91/12 248/188.9
3,013,688 A * 12/1961 Luning ..... A47G 23/03 215/376
3,232,253 A * 2/1966 Winters ..... A47B 91/022 297/344.12
3,438,342 A * 4/1969 Woolworth ..... B65D 19/0028 108/56.3
3,524,614 A * 8/1970 Sorth ..... A47G 23/0225 248/131
D257,247 S * 10/1980 Powers ..... F16B 12/48 D34/38
D398,731 S * 9/1998 Pigott ..... A47B 91/022 D34/38
6,170,131 B1 * 1/2001 Shin ..... A41F 1/002 24/303
D437,423 S * 2/2001 Lin ..... D25/114
D474,871 S * 5/2003 Bas ..... D34/38
6,715,840 B2 * 4/2004 Martin ..... A47C 3/38 297/463.1
D498,412 S * 11/2004 Pehta ..... A47B 91/12 D8/374
D531,568 S * 11/2006 Davidian ..... B65D 19/0028 D12/217
D645,980 S * 9/2011 Schrom ..... D25/113
D657,069 S * 4/2012 Brazier ..... D25/113
D793,786 S * 8/2017 Rawls-Meehan ..... A47B 91/12 D6/709
10,053,344 B1 * 8/2018 Angel ..... B60P 3/36
(Continued)

FOREIGN PATENT DOCUMENTS

GB 2464557 A * 4/2010 ..... A47B 91/02

*Primary Examiner* — Jonathan Liu
*Assistant Examiner* — Guang H Guan
(74) *Attorney, Agent, or Firm* — J. Bennett Mullinax, LLC

(57) ABSTRACT

A molded plastic support foot is provided having an overall conical shape and further defining a plurality of internal openings, that extend substantially a height of the support foot and provide a load bearing structure that can be used to support and elevate heavy objects off a floor or worksurface.

16 Claims, 2 Drawing Sheets

(56) References Cited

U.S. PATENT DOCUMENTS

| | | | | |
|---|---|---|---|---|
| 10,082,238 | B1 * | 9/2018 | Norris | F16M 11/22 |
| 10,525,942 | B2 * | 1/2020 | Andersen | B60S 9/02 |
| 10,611,346 | B2 * | 4/2020 | Andersen | B60S 9/22 |
| 2021/0007482 | A1 * | 1/2021 | Phipps | A47B 91/12 |

* cited by examiner

EQUIPMENT SUPPORT APPARATUS

FIELD OF THE INVENTION

This invention is directed towards an equipment support device which may be in the form of a conical foot that is designed to support and elevate equipment above a floor or work surface. The foot support is particularly useful for ferrous objects that might rust when in contact with a damp floor or could be exposed to liquids during floor maintenance and cleaning operations.

BACKGROUND OF THE INVENTION

It is known in the art to elevate equipment, materials, and product inventory above a floors surface, Various types of permanent or temporary shelving, racks, and the use of wooden blacks or plastic foots are frequently used to elevate large or heavy items when stored on the floor. In some instances, the support feet are permanently attached to the supported item. In other instances, the foots or support items are not secured to either the equipment or the floor and may be inadvertently moved or in an improper location when an item is being positioned or repositioned. In many instances, wood blocks and pallets that might be used to elevate an item tend to generate wood scraps which negatively affect the cleanliness and safety of the work environment. Additionally, wood surfaces will often chemically react with the surface of a supported metal component. For metals that may be subjected to a subsequent and anoclization process, painting or powder coating, the chemical reaction may render the metal surface unsuitable for such coatings and processes.

Additionally, wooden supports are typically not secured to the supported metal objects so movement of the objects from one position to another requires removing the wooden blocks from one location and requiring a separate step of placing new blocks at a new, repositioned location. Accordingly, there is room for variation and improvement in the art.

SUMMARY OF THE INVENTION

It is one aspect of at least one of the present embodiments to provide for a support foot comprising an upper surface; a lower surface, the lower surface having a larger surface area than the upper surface and connected by an intervening tapered wall, the interconnecting tapered wall further defining a portion of a plurality of wall cavities defined within an interior of the support foot, a respective upper edge and lower edge of the plurality of walled cavities extending from the upper surface to the lower surface, the interior of the support foot further defining a central cavity extending substantially the height of the support foot and the central cavity adapted for receiving a magnet along an upper surface of the central cavity; wherein, when the top surface of the foot is placed beneath a ferrous object, the foot will attach to the ferrous object, supporting the ferrous object when positioned on, a floor and further staying attached to the ferrous object when elevated or moved to an alternative location, on the floor.

It is one aspect of at least one of the present embodiments to provide for a support foot wherein a lower surface of the central cavity is adapted for receiving one of either a magnet or a ferrous metal member.

It is one aspect of at least one of the present embodiments to provide for a support foot wherein at least one of an upper portion of the central cavity or a portion of the lower cavity further defines a threaded female connector for receiving a threaded male connector.

It is one aspect of at least one of the present embodiments to provide for a support foot an upper surface; a lower surface, the lower surface having a larger diameter than the upper surface; a curved exterior conical wall having an interior surface forming an edge wall for a plurality of cavities, each cavity extending substantially a height of the cone; a plurality of arms extending from an edge wall defining a central cavity, the central cavity extending substantially a height of the support foot; a magnet secured within an upper portion of the central cavity; and at least one of a magnet or ferrous member secured within a lower surface of the central cavity.

It, is one aspect of at least one of the present embodiments to provide for a support foot wherein each of the plurality of arms extends substantially the entire height of the support foot.

It is one aspect of at least one of the present embodiments to provide for a support foot wherein each of the plurality of circumferential cavities has an opening along the top surface which has a smaller cross sectional area than a cross sectional area of a bottom opening of the cavity.

It is one aspect of at least one of the present embodiments to provide for a support foot wherein the circumferential cavity opening is substantially semi-circular along a top edge and is substantially circular along a bottom edge.

It is one aspect of at least one of the present embodiments to provide for a support foot 4 wherein opposing edge walls of each circumferential cavity further defines a lip 70 which extends between adjacent circumferential cavities, each lip having an upper surface that is substantially parallel with a plane of an upper surface of the foot and has a thickness, as measured in reference to a height of a foot at least about 0.1 inches.

It is one aspect of at least one of the present embodiments to provide for a support foot wherein a plurality of mid-section cavities are formed between the exterior wall of the central cavity and interior walls of the circumferential cavity, the mid-section cavities extending substantially the entire height of the foot.

It is one aspect of at least one of the present embodiments to provide for a support foot wherein each of the plurality of arms lies along a radius of the cylindrical foot.

It is one aspect of at least one of the present embodiments to provide for a support foot wherein the plurality of arms lies along a plane which bisects the central cavity and further bisects two oppositely spaced circumferential cavities.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
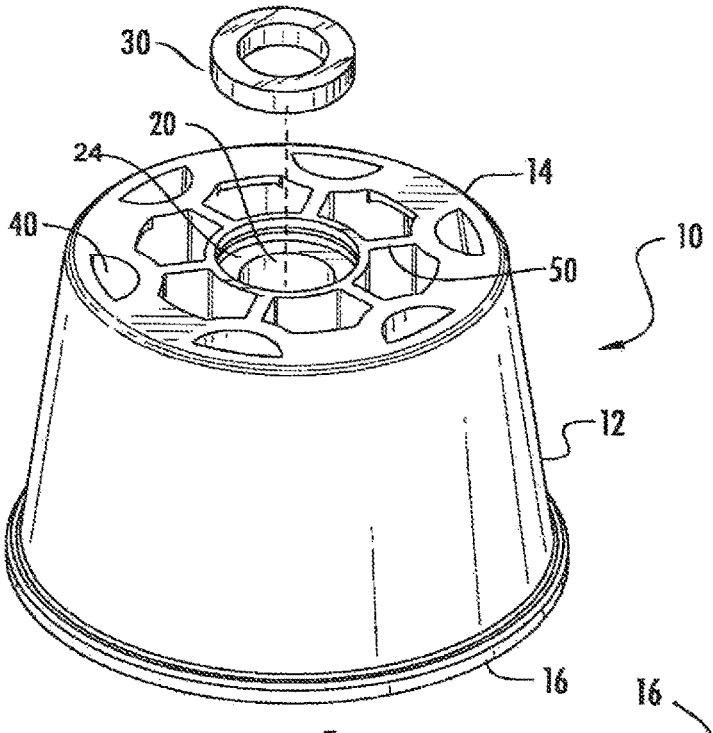
FIG. 1 is a perspective view of one embodiment of a support foot.

As seen in reference to FIG. 1, a support device, in the nature of a foot 10 is provided that may be used to secure and support large ferrous metal objects. The foot is designed to support such objects in an elevated and spaced position above a floor surface that may cause corrosion, oxidation or rust if in contact with the metal object.

Figure 2:
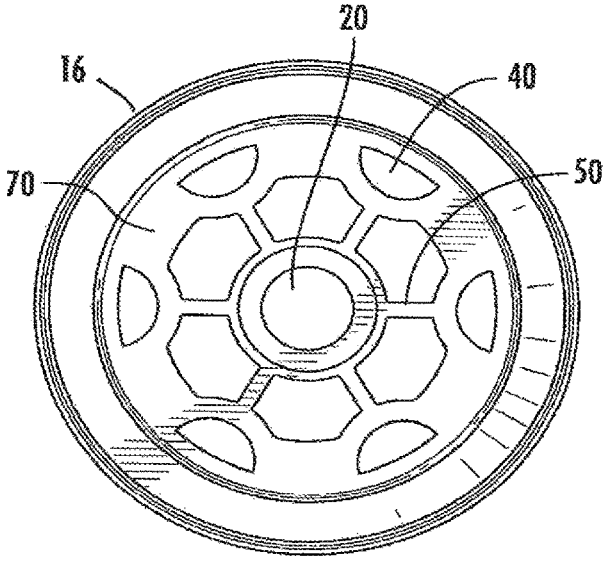
FIG. 2 is a top view of the support foot seen in FIG. 1.
Figure 3:
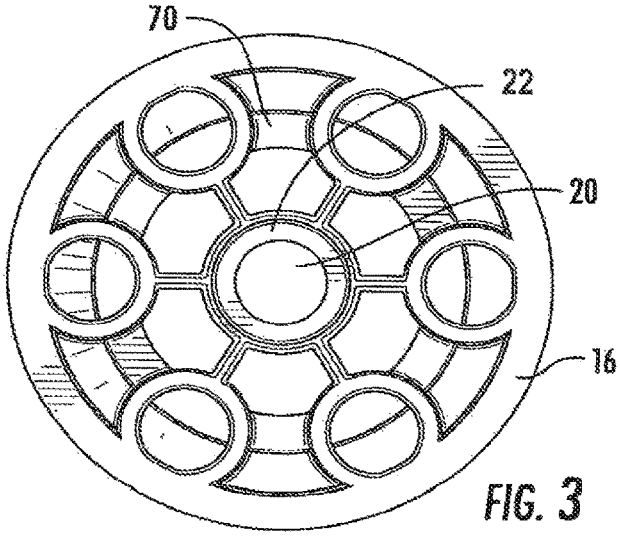
FIG. 3 is a bottom view of the support foot seen in FIG. 1.

The support foot 10, as seen in reference to FIGS. 1-3, provides an elegant solution to many of the problems within the prior art. As illustrated, foot 10 is conical shape having a curved end wall 12 which interconnects with a top portion 14, a bottom portion 16, bottom portion 16 having a larger diameter than the top portion 14.

As seen in reference to FIGS. 1-3, a central cavity 20, which may be in the form of a cylinder, substantially extends the entire height of the foot 10. An upper portion of the cylinder 20 defines a ledge 24 which is adapted for receiving therein a magnet 30. In the illustrated embodiments of FIGS. 1-3, the ledge and magnet may be of a complementary shape such as circular. Preferably, the magnet 30 fits within ledge 24 such that the upper surface of the magnet is flush with the upper foot top 14. A similar ledge 22 with magnet 30 may be attached to the bottom 16 of foot 10 within the opening 20 and is best seen in FIG. 3. If desired, the magnet 30 may be replaced with a similarly shaped ferrous metal which allows two or more feet to be stacked on top of one another and secured by the magnet 30 of one foot which engages the ferrous disc. The stacked feet allow for easy storage and, within the safety limits of the load bearing limits of feet 10, allow for multiple feet 10 to be stacked beneath support items such as molds, machinery parts, and other heavy loads.

Around the perimeter of each foot 10 there are a plurality of circumferential cavities 40 defined within the foot 10. Along the top surface 10, each cavity 40 has a substantial semi-circular shape. As the foot tapers downwardly, the cross section of the cavity 40 increases and as the cavity 40 approaches the bottom surface 16, cavity 40 becomes nearly circular in shape.

A wall 50 connects an exterior wall of each cavity 40 to the central cavity 20 and extends along substantially the entire height of the respective walls of cavity 20 and a corresponding wall of cavity 40. As best seen in reference to FIG. 2, each wall 50 lies along the radius of foot 10 and wall 50 further engages the central cavity 20 and perimeter cavity 40 in a substantially perpendicular manner.

As seen in reference to FIGS. 2 and 3, a collar region 70 interconnects the adjacent outer cavities 40. The thickness of each portion of the collar region is at least about 0.1 inches. A thickness of collar region 70 in a range of 0.1 to 0.35 is used with the present invention. Preferably, collar 70 does not extend the entire height of the foot 10.

The arrangement of the corresponding parts described above describe a load bearing structure the strength of which is derived, in part, from the combination of multiple load bearing shapes and structures in a single combined foot structure.

The overall shape of the conical foot provides load bearing properties. Additionally, the center cylinder which defines the central cavity 20 provides a cylindrical loading bearing support. The outer perimeter cavities 40 each define a curved, open wall structure which is close to cylindrical shape along a bottom of foot 10 and tapers to a semi-circular hollow shape along a top 14 of the foot 10. The curved outer wall of each cavity 40 is contiguous with a portion of the cylinder wall 12, which also strengthens the load bearing properties of the foot 10. The multiple walls 50 provide both compressive strength along a vertical direction of the foot and also help redistribute laterally to help distribute forces evenly along a width of the foot 10. The collar region 70 also provides for a large surface area to the top 14 to help in the distribution of forces to the wall 12 in the walls of the adjacent cavities 40.

The foot 10 uses an effective arrangement of physical structures, is lightweight, and offers excellent strength and compression characteristics. One suitable polymer that can be used is a co-polymer of polypropylene with about 10% to about 15% by weight of randomly oriented chopped glass fibers. The combination of the co-polymer of polypropylene and the glass fibers provides an end product that is not subject to cracking and sudden failure. Rather, if safety rating values or environmental conditions are exceeded, the polymer foot tends to bend and deform rather than undergo a catastrophic failure. This provides a margin of safety with respect to the support foot when used to support heavy items.

By way of a non-limiting example, the support foot can come in a variety of heights such as a 2 inch, 3 inch and 4 inch versions. For certain embodiments, a steel ring and male locator can be provided on the base of the units along with female locators on the top of the foot. This allows the user to stack a support foot on top of a larger foot that is designed to matingly engage. This allows the user to provide different support heights relative to the metal object and the support floor.

As seen in reference to the figures, a washer shaped magnet may fit within a diameter counterbore on the top of each foot allowing the foot to magnetically attach to the surface of any ferrous material. Located on the bottom of each foot may be another counterbore that contains a ferrous ring or magnet and thereby allows the feet to be stacked, one on top of the other, magnetically held together, or stored on a ferrous containing structure.

As further seen in reference to the figures, the foot forms an overall conical body that is supported by seven towers or cavities, six of the cavities being partially contiguous with an interior of the conical wall and a central cavity which, may in turn, be interconnected by a support arm to each of the six surrounding cavities. The upper surface of each of the support foots, including the cavities, may be open on the top and allow for a balanced and level support structure even when attached to a dirty or unclean surface.

When properly used, the support apparatus can keep ferrous materials and objects elevated off of a shop or tool house floor. This can assist in allowing a fork lift to have easy access to the underside of the supported object and at the same time keeps the object off the damp floors where corrosion or other damage could occur.

Figure 4:
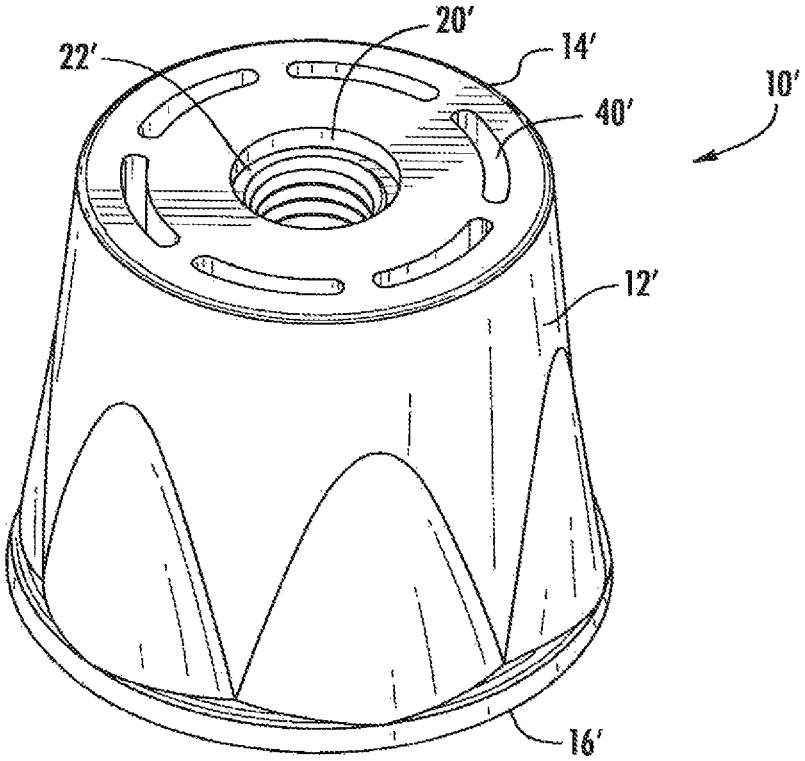
FIG. 4 is a perspective view of an alternative embodiment of a support foot.
Figure 5:
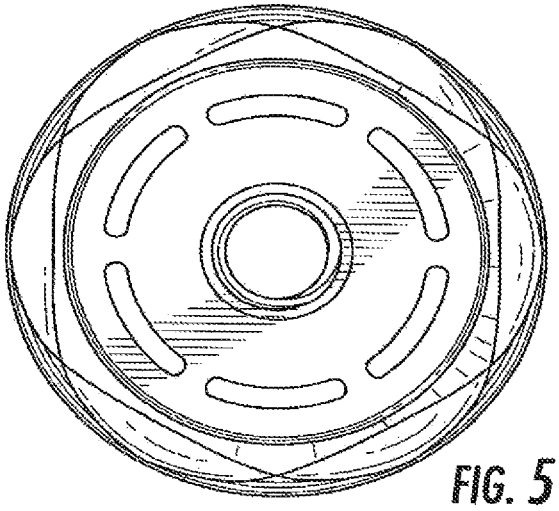
FIG. 5 is a top view of the support foot seen in FIG. 4.
Figure 6:
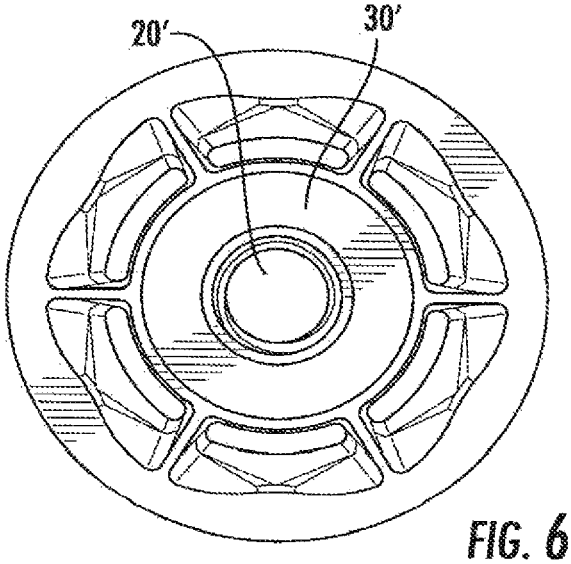
FIG. 6 is a bottom view of a support foot as seen in FIG. 4.

An alternative embodiment of the support foot can be seen in reference to FIGS. 4-6. The (') is used to indicate similar functioning parts and components to the structure described in reference to FIGS. 1-3. As seen in reference to FIGS. 4-6, the foot 10' defines a central bore 20'. An upper surface 14' of foot 10' may further define a ledge 22'. Ledge 22' can support a disc or washer sized magnet.

The cylindrical side wall 12' tapers outwardly as the wall extends from the upper surface 14' to the bottom surface 16' of foot 10'. A plurality of circumferential edge walls 40' are provided that have slit like openings along an upper edge as seen in FIGS. 4 and 5 and which transition to a larger opening along bottom 16'. As seen in FIG. 6, the bottom 16' can have a portion of the foot surrounding the central bore 20' adapted for receiving either a magnet 30' or alternatively, a similarly shaped ferrous member such as a washer or disk and in a substantially flush arrangement with the surface that forms the bottom 16'.

Ledge 22', when threaded, will allow the use of a correspondingly mated insert to be secured thereto. The insert can support a smaller support foot or have a free end of the insert adapted for insertion and/or retention within an object to be supported.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained therein.

That which is claimed:

1. A conical support foot comprising:

a top portion;

a bottom portion defining a larger diameter than the top portion;

a curved circumferential wall connecting the top portion to the bottom portion, the curved circumferential wall tapering from the bottom portion to the top portion;

a hollow cylinder disposed within an interior of the conical support foot and extending from the top portion to the bottom portion along a longitudinal axis of the conical support foot, the hollow cylinder including an upper ledge defining an upper counterbore and a lower ledge defining a lower counterbore;

a magnet disposed on the upper ledge within the upper counterbore, the magnet having an upper surface flush with an upper surface of the top portion;

a ferrous member disposed within the lower counterbore;

a plurality of arcuate walls;

a plurality of circumferential cavities, each of the plurality of circumferential cavities defined by the curved, circumferential wall and a respective one of the plurality of arcuate walls, a cross-sectional area of each of the plurality of circumferential cavities increasing from the top portion to the bottom portion such that each of the plurality of circumferential cavities has a substantially semi-circular cross-sectional shape at the top portion and a substantially circular cross-sectional shape at the bottom portion;

a plurality of inner walls, each of the plurality of inner walls radially extending from the hollow cylinder to a respective one of the plurality of arcuate walls;

a plurality of inner cavities, each of the plurality of inner cavities defined by the curved circumferential wall, the hollow cylinder, respective ones of the plurality of arcuate walls, and respective ones of the plurality of inner walls; and a plurality of lips disposed at the top portion, each of the plurality of lips connecting two respective adjacent ones of the plurality of arcuate walls.

2. The conical support foot according to claim 1, wherein the hollow cylinder substantially extends an entire height of the conical support foot.

3. The conical support foot according to claim 1, wherein each of the plurality of inner walls substantially extends an entire height of the conical support foot.

4. The conical support foot according to claim 1, wherein two oppositely spaced inner walls of the plurality of inner walls lie in a plane that bisects the hollow cylinder.

5. The conical support foot according to claim 1, wherein each of the plurality of inner walls engages the respective one of the plurality of, arcuate walls in a substantially perpendicular manner.

6. The conical support foot according to claim 1, wherein the plurality of inner walls are configured to provide compressive strength along the longitudinal axis of the conical support foot and help redistribute forces laterally.

7. The conical support foot according to claim 1, wherein each of the lips does not extend an entire height of the conical support foot.

8. The conical support foot according to claim 1, wherein a thickness of each of the lips is in a range from 0.1 inches to 0.35 inches.

9. The conical support foot according to claim 1, wherein the magnet has a washer shape.

10. The conical support foot according to claim 1, wherein the magnet is configured to magnetically attach to a ferrous object placed on the top portion.

11. The conical support foot according to claim 1, wherein the ferrous member is a ferrous ring.

12. The conical support foot according to claim 1, wherein the conical support foot is configured to support an object in an elevated and spaced position above a floor surface.

13. The conical support foot according to claim 1, wherein the conical support foot is a first conical support foot, wherein the first conical support foot is configured to support a second conical support foot having an identical construction as the first conical support foot.

14. The conical support foot according to claim 13, wherein the magnet of the first conical support foot is, configured to engage the ferrous member of the second conical support foot to secure the second conical support foot on top of the first conical support foot.

15. The conical support foot according to claim 1, wherein the conical support foot is made from glass fibers and a co-polymer of polypropylene.

16. The conical support foot according to claim 1, wherein the conical support foot has a height of 2 inches, 3 inches, or 4 inches.

* * * * *